United States Patent [19]

Ling

[11] Patent Number: 4,742,700

[45] Date of Patent: May 10, 1988

[54] LINEARLY OPERATING SIDE-LOCKED PADLOCK

[76] Inventor: Chong-Kuan Ling, P.O. Box 53-58, Taipei, Taiwan

[21] Appl. No.: 88,568

[22] Filed: Aug. 24, 1987

[51] Int. Cl.[4] ..... E05B 37/14

[52] U.S. Cl. ..... 70/25; 70/323

[58] Field of Search ..... 70/25, 22, 26, 312, 70/316, 323, 321, 322

[56] References Cited

U.S. PATENT DOCUMENTS

| | | | |
|---|---|---|---|
| 330,647 | 11/1885 | Walker et al. | 70/25 |
| 1,252,715 | 1/1918 | Papini | 70/25 |
| 3,388,572 | 2/1968 | Morin | 70/315 |

FOREIGN PATENT DOCUMENTS

| | | | |
|---|---|---|---|
| 186524 | 10/1922 | United Kingdom | 70/25 |

*Primary Examiner*—Robert L. Wolfe

[57] ABSTRACT

A padlock includes a casing having an U-shaped fixed shackle protruding on a side wall of the casing, a reciprocating actuator linearly moving in the casing and having a movable shackle fastener formed thereon to operatively form a loop with the U-shaped fixed shackle for locking purpose, a plurality of dials and clutch wheels rotatably mounted in the casing with each dial resiliently engaging with each clutch wheel, wherein the reciprocating actuator includes plural pairs of longitudinal extensions, adapted to be operatively obstructed against the clutch wheels when downwardly depressing the actuator to lock the padlock, or adapted for operatively clamping the plural clutch wheels to allow the free rotation of the dials for setting a new combination when downwardly depressing the actuator to open the shackle.

6 Claims, 2 Drawing Sheets

LINEARLY OPERATING SIDE-LOCKED PADLOCK

BACKGROUND OF THE INVENTION

Irving Feinberg et. al. disclosed a combination padlock in their U.S. Pat. No. 3,720,082 as constructed by multiple dials and sleeves rotatably mounted on a shackle enabling the changing or setting of a lock combination. Whenever locking such a conventional padlock, the shackle must be first opened and turned in an angle to allow the free leg of the shackle leaving apart from its engaged socket, adapted to be locked in a locking object (such as a loop) mounted on a door or door frame, which, however, must be operated by two hands of a user to thereby cause the operating inconvenience. Meanwhile, when it is intended to change a setting combination, the shackle must also be turned in an angle by a user's two hands and then depressed downwardly to disengage its sleeves from the dials to thereby cause operating inconvenience.

The present inventor has found the defects of such a conventional padlock and invented the present linearly operating padlock.

SUMMARY OF THE INVENTION

The object of the present invention is to provide a padlock including a casing having an U-shaped fixed shackle protruding on a side wall of the casing, a reciprocating actuator linearly moving in the casing and having a movable shackle fastener formed thereon to operatively form a loop with the U-shaped fixed shackle for locking purpose, a plurality of dials and clutch wheels rotatably mounted in the casing with each dial resiliently engaging with each clutch wheel, wherein the reciprocating actuator includes plural pairs of longitudinal extensions, adapted to be operatively obstructed against the clutch wheels when downwardly depressing the actuator to lock the padlock, or adapted for operatively clamping the plural clutch wheels to allow the free rotation of the dials for setting a new combination when downwardly depressing the actuator to open the shackle.

DETAILED DESCRIPTION

Figure 1:
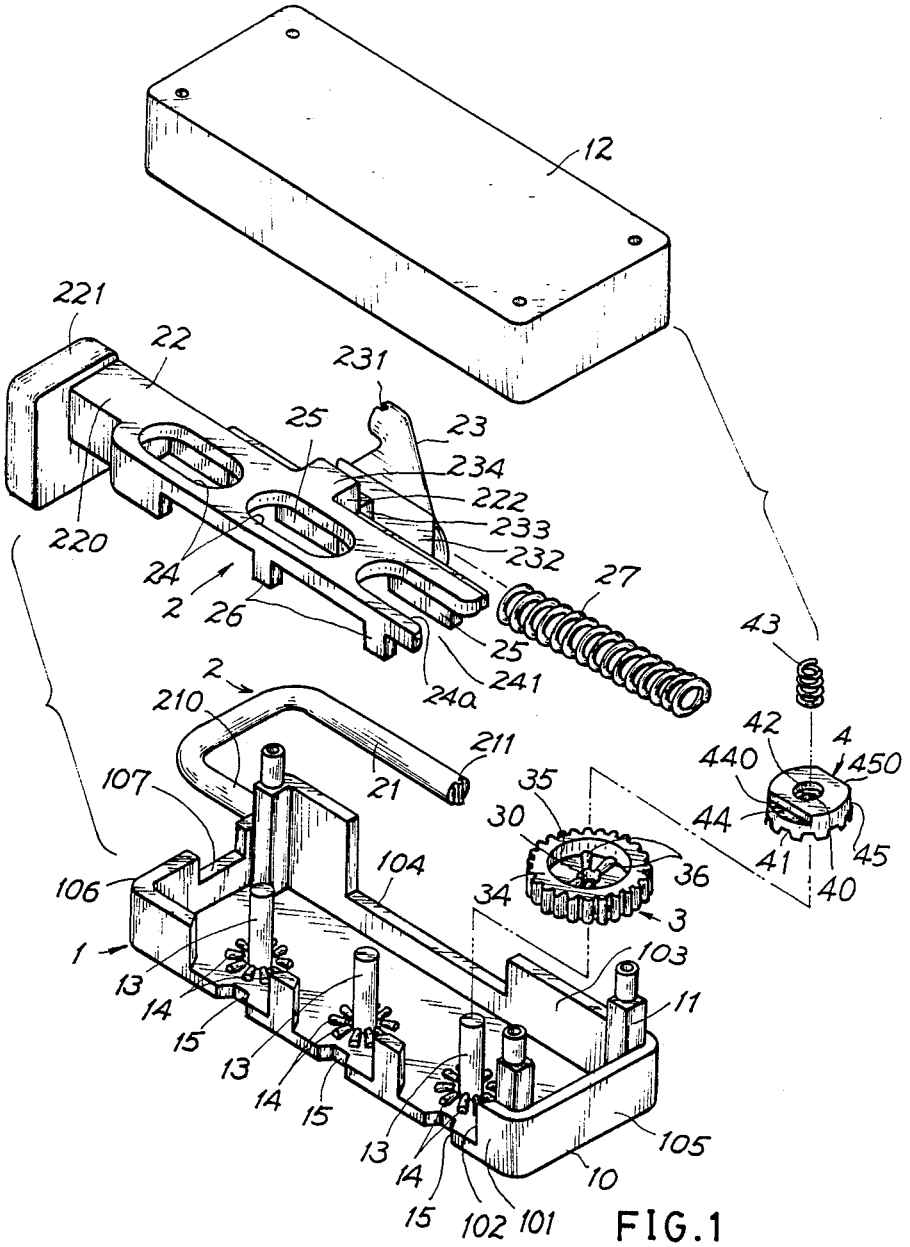
FIG. 1 is an exploded illustration showing all elements constructing the present invention.
Figure 2:
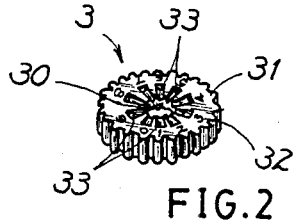
FIG. 2 is an illustration showing a dial of the present invention when inverting the dial as shown in FIG. 1.

As shown in the figures, the present invention comprises: a casing 1, a locking means 2, a plurality of dials 3 and a plurality of clutch wheels 4.

The casing 1 includes: a base 10 generally shaped as a rectangle having a left side wall 101, a right side wall 103, a lower side wall 105 and an upper side wall 106 having three or four columns 11 formed on four corners thereof, a cover 12 secured to the base 10 by rivetting or fixing the cover 12 on the four columns 11, a plurality of pivots 13 protruding on the base proximate to the left side wall 101 each pivot 13 having plural radial extensions 14 disposed around the lower portion of the pivot 13, a plurality of notches 15 formed on the base for showing the combination as revealed by the dials 3, plural dial openings 102 corresponding to the dials 3 formed on the left side wall 101, a longitudinal slot 104 formed on the right side wall 103, and an upper opening 107 formed on the upper side wall 106.

The locking means 2 includes: an U-shaped fixed shackle 21 having its short leg 210 secured to an upper side wall 106 and having its long leg 211 protruding downwardly in parallel with the right side wall 103, a reciprocating actuator 22 generally shaped as a rectangle having a movable shackle fastener 23 protruding rightwardly from the actuator through a holder plate 233, plural longitudinal slots 24 linearly formed on the actuator 22 each disposed around each pivot 13 having a lowest slot 24*a* formed as an U-shaped notch 241, each slot 24 or 24*a* formed with a long extension 25 on its right side and a short extension 26 on its left side, a restoring spring 27 as limited between a retainer 234 protruding from the holder plate 233 and a lower side wall 105, a neck portion 220 formed on an upper portion of the actuator slidingly moving through the upper opening 107 and secured with a depression button 221 on an uppermost end of the actuator. The movable shackle fastener 23 includes a protruding rod 231 forming a locking loop with the long leg 211 of the shackle 21, a shielding plate 232 secured between the holder plate 233 and the protruding rod 231 parallelly moving outside the right side wall 103 operatively closing the longitudinal slot 104 when locking the padlock, and holder plate 233 secured to the actuator 2 for slidingly reciprocating along the right side slot 104.

Each dial 3 includes a central hole 30 for rotatably mounting the dial on each pivot 13, combination numbers 32 from 0, 1 . . . 9 radially disposed on a perimeter of a bottom surface 31 facing each notch 15 formed on the base, a plurality of radial grooves 33 formed on the bottom surface 31 of the wheel 3 engageable with the radial extensions 14 formed on the base 10, a shallow circular recess 35 formed on an upper surface 34 opposite to the bottom surface 31 engageable with each clutch wheel 4 snugly engaged in the recess 35 and plural radial extensions 36 formed on a bottom portion of the recess 35. The dial 3 can be mounted in a manner to protrude its partial periphery outwardly through each opening 102 formed on the left side wall 101.

Figure 1A:
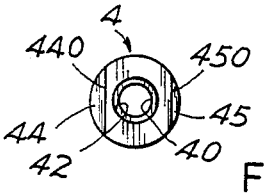
FIG. 1*a* is a top view of a clutch wheel of the present invention.

Each clutch wheel 4 includes a central hole 40 for rotatably mounting the wheel on each pivot 13 above each dial 3, plural radial grooves 41 formed on its bottom surface engageable with the plural radial extensions 36 of the dial 3, a spring socket 42 formed on its upper surface for retaining a spring 43 defined between the socket 42 and the cover 12 when mounted on the base 10, a long secant recess 44 formed on one side of the upper surface of wheel 4, and a short secant recess 45 formed on the other side of the upper wheel surface having its chord edge 450 parallel to a chord edge 440 of the long recess 44 as shown in FIG. 1*a*. The wheel 4 is resiliently engaged with each dial 3 as retained by the spring 43 jacketed in the socket 42 for their superimposed rotation.

Figure 6:
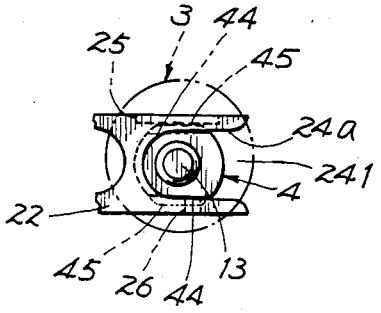
FIG. 6 shows a relationship of a clutch wheel with the extensions of the present invention.

The long secant recess 44 is operatively engaged with the short extension 26 of the actuator 22, while the short secant recess 45 is operatively engaged with the long extension 25 of the actuator. The width of the short extension 26 is equal to a distance as spaced between the chord 440 of the long secant recess 44 and the left side wall 101, while the width of the long extension 25 is smaller than that of the short extension. The two recesses 44, 45 are each formed with a chord 440, 450 respectively intersecting with the upper surface of the wheel 4 so that the two chords 440, 450 are parallel with each other. In order to prevent double opening number of the present invention, the two chords 440, 450 are different in length so that when rotating the short secant recess 45 downwardly as shown in dotted line of FIG. 6, the short extension 26 will be obstructed against the wheel 4, unable to open the lock, so that even two parallel recesses 44, 45 are formed in this invention, only one opening number is allowable for opening the lock of the present invention.

Figure 4:
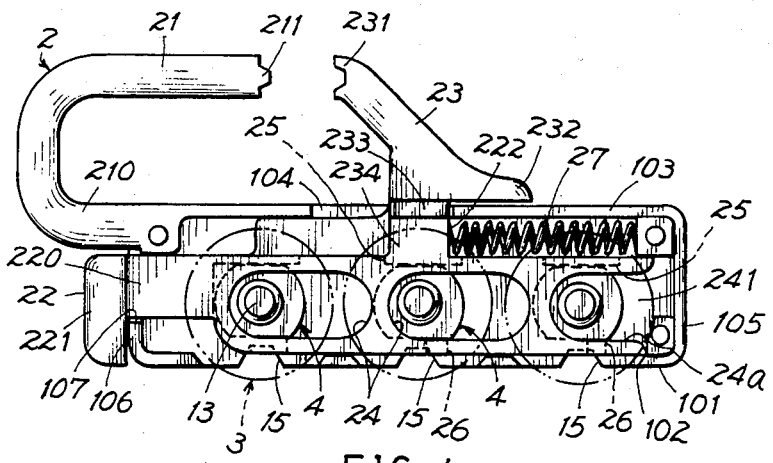
FIG. 4 is an illustration showing the present invention when opened.

When opening the present invention, the dials 3 are rotated to their opening numbers as predetermined to allow the wheels 4 rotating to a position in which two chords 440, 450 of the two recesses 44, 45 are ready to pass each pair of extensions 25, 26 formed on actuator 22 as shown in FIG. 4, and the button 221 is depressed downwardly to lower the movable shackle fastener 23 to unlock the upper shackle 21 since the extensions 25, 26 are no longer obstructed by the wheels 4. If for setting a new combination of the present invention, the button 221 is continuously depressed against the resilience force by the restoring spring 27 to allow the two extensions 25, 26 clamping the two secant recesses 44, 45 to lock each wheel 4 and then the dials 3 can be free rotated, without being coupled by the wheels 4, for changing the combination.

Figure 3:
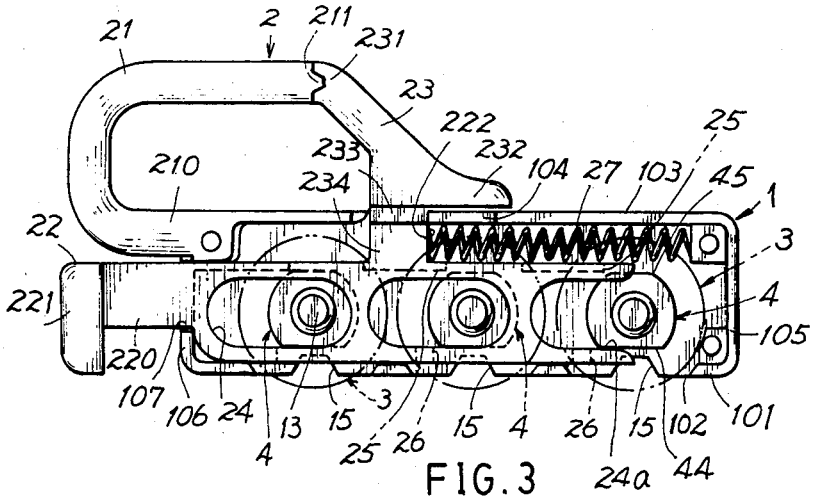
FIG. 3 is an illustration showing the present invention when closed.
Figure 5:
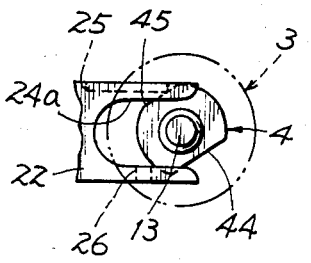
FIG. 5 shows an obstruction of the extensions against the clutch wheel of the present invention.

After releasing the button 221, the movable shackle fastener 23 is restored by the spring 27 to close the shackle 21 for locking the present invention on a lock loop and the dials 3 are optionally rotated to confuse the opening number of the lock. When extending the actuator 22 upwardly, the two extensions 25, 26 should disengage the two recesses 45, 46 respectively with only a slight tolerance as shown in FIG. 3 so that once rotating the dial/wheel to a locking situation as shown in FIG. 5, any slight depression of the actuator 22 will cause the extensions 25, 26 being obstructed by the clutch wheel 4 to prevent the opening of the shackle 21 and the fastener 23.

The most important advantage of the present invention superior to a conventional padlock is that the opening or closing of the shackle is linearly operated by a user's single hand for quicker, convenient and precise purposes. The movable shackle fastener 23 relative to the fixed shackle 21 are provided aside the casing 1 to increase the stroke of the actuator 22, thereby increasing the shackle opening that is helpful for smoother locking or opening operations.

I claim:

1. A linearly operating side-lock padlock comprising:

a casing including a base generally shaped as a rectangle having plural pivots formed thereon and having a left side wall formed with plural dial openings, a right side wall formed with a longitudinal slot, a lower side wall, and an upper side wall formed with an upper opening and a cover mounted on said base;

a locking means including an U-shaped fixed shackle having its short leg protruding on the upper side wall and having its long leg parallelly formed aside the right side wall, a reciprocating actuator generally shaped as a rectangle having a movable shackle fastener protruding rightwardly thereon for slidingly reciprocating through said longitudinal slot on said right side wall and operatively formed a loop with the long leg of said shackle, plural longitudinal slots formed on said actuator each disposed around each said pivot on said base, plural pairs of extensions formed on both right and left sides if each said slot on the actuator, a restoring spring resiliently retaining said actuator upwardly against said lower side wall of said casing and a button secured to a neck portion of said actuator reciprocating through said opening on said upper side wall;

plural dials each rotatably mounted on each said pivot and partially protruding leftwardly through said dial openings formed on said casing; and plural clutch wheels each rotatably mounted on each said pivot and superimposedly engaged with each said dial as retained by a spring jacketed on said pivot, said wheel formed with two secant recesses operatively engaged with said two extensions formed on said actuator, whereby upon the downward depression of said button of said actuator and upon the rotating of said wheels to allow each said pair of extensions on said actuator passing said secant recesses of said wheel, said movable shackle fastener is separated from said U-shaped shackle to unlock the padlock.

2. A padlock according to claim 1, wherein said pivot on said base is formed with plural radial extensions on said base to resiliently engage with plural radial grooves formed on a bottom surface of said dial; said dial having its upper surface formed with a shallow circular recess having radial extensions formed thereon, superimposedly engaged, by a spring retained between said wheel and said cover, with said clutch wheel of which the bottom surface is formed with plural radial grooves engageable with said extensions of said shallow recess of said dial.

3. A padlock according to claim 1, wherein said clutch wheel has said two secant recesses formed as a short secant recess on its one side and a long secant recess on the other side thereof, both said secant recesses each having a chord edge formed by intersecting with an upper surface of said wheel and said two chords having different length and being parallel with each other.

4. A padlock according to claim 1, wherein said pair extensions of said actuator include a long extension formed on one side of said slot on said actuator, and a short extension formed on the other side of said slot opposite to said long extension, said long extension operatively engaged with said short secant recess of said wheel and said short extension operatively engaged with said long secant recess of said wheel.

5. A padlock according to claim 4, wherein both said extensions of said actuator should disengage said two recesses respectively with only a slight tolerance when said actuator is upwardly extended as locked, so that any slight rotation of said wheel may easily obstruct said extensions to prevent the opening of said lock.

6. A padlock according to claim 1, wherein said movable shackle fastener includes a protruding rod operatively closing said U-shaped fixed shackle secured to a holder plate protruding from said actuator; and a shielding plate secured between said holder plate and said protruding rod, and slidingly moving through said slot on said right side wall of said base and operatively closing said slot when closing said shackle.

* * * * *